US006557744B2

(12) United States Patent
Kitamura

(10) Patent No.: US 6,557,744 B2
(45) Date of Patent: May 6, 2003

(54) STAPLE JUMP PREVENTING MECHANISM FOR STAPLE CARTRIDGE

(75) Inventor: Takuya Kitamura, Tokyo (JP)

(73) Assignee: Max Co., Ltd., Tokyo (JP)

( * ) Notice: Subject to any disclaimer, the term of this patent is extended or adjusted under 35 U.S.C. 154(b) by 90 days.

(21) Appl. No.: 09/773,515

(22) Filed: Feb. 2, 2001

(65) Prior Publication Data

US 2001/0035448 A1 Nov. 1, 2001

(30) Foreign Application Priority Data

Feb. 2, 2000 (JP) ..... 2000-025274

(51) Int. Cl.[7] ..... B27F 7/21

(52) U.S. Cl. ..... 227/119; 227/120; 227/131; 227/136

(58) Field of Search ..... 227/120, 131, 227/136, 135, 137, 119, 123, 127

(56) References Cited

U.S. PATENT DOCUMENTS 5,823,415 A * 10/1998 Udagawa et al. ..... 227/131
6,050,471 A * 4/2000 Yagi ..... 227/120

FOREIGN PATENT DOCUMENTS

TW 265666 12/1995

* cited by examiner

*Primary Examiner*—Scott A. Smith
(74) *Attorney, Agent, or Firm*—Morgan, Lewis & Bockius LLP

(57) ABSTRACT

A staple cartridge including a storage portion and a staple feeding passage. The storage portion stores a connected staple constituted by connecting a large number of straight staples. The staple feeding passage is for feeding the connected staple stored in the storage portion. A stopper is protruded to an inside of the staple feeding passage for preventing the connected staple from being moved to a discharge side. The stopper is formed on both sides of a discharge port provided on a tip of the staple feeding passage.

13 Claims, 7 Drawing Sheets

STAPLE JUMP PREVENTING MECHANISM FOR STAPLE CARTRIDGE

BACKGROUND OF THE INVENTION

1. Field of the Invention

The present invention relates to a staple jump preventing mechanism for preventing a connected staple from jumping to the outside of a staple cartridge when a part of the connected staple is cut in order to eliminate a jam generated in a tip portion of the connected staple in a stapler.

2. Description of the Related Art

There has been known a stapler removably provided with a staple cartridge storing a connected staple, which is a large number of straight staples like a band and winding them like a roll. Also in this type, when a jam phenomenon is generated in a tip portion of the connected staple and the staple jumps out of a discharge port of the staple cartridge during cutting and separation of a part of the connected staple to eliminate the jam phenomenon, there is a possibility that operational failures of a forming mechanism or a driving mechanism of the straight staple might be caused. For this reason, it is necessary to prevent the connected staple from jumping out of the staple cartridge when cutting the connected staple.

However, the connected staple of the roll staple is continuous from a start point to a termination. Therefore, when the staple is pulled out, it correspondingly comes out of a discharge port. In addition, the staple cartridge is provided with a reversal check pawl for preventing the connected staple from being moved in a direction reverse to a direction of pull-out thereof. For this reason, even if a portion jumping after cutting the connected staple is to be returned into the cartridge, the connected staple is not moved in the reverse direction. Accordingly, the excessively jumping portion should be cut again after the cutting. Therefore, a work for removing a jammed staple is troublesome.

Also in a stapler using a staple cartridge stacking and storing sheet-shaped staples connecting a large number of straight staples like a sheet, similarly, when a staple 2B is pulled out during the removal of jammed staples as shown in FIG. 8, the connected staple cannot be moved in a direction reverse to the direction of pull-out due to the presence of the reversal check pawl (not shown) provided in a staple feeding passage. Also in this case, accordingly, there is a problem in that a work for processing a jam is troublesome.

SUMMARY OF THE INVENTION

In order to eliminate the drawbacks, it is an object of the invention to provide a staple jump preventing mechanism for a staple cartridge which can effectively prevent a connected staple from jumping out of the cartridge during a processing of removing a jammed staple.

In order to solve the problem, the invention provides a staple jump preventing mechanism for a staple cartridge comprising a storage portion for storing a connected staple constituted by connecting a large number of straight staples and a staple feeding passage for feeding the connected staple stored in the storage portion, wherein a stopper protruded toward an inside of the staple feeding passage for preventing the connected staple from being moved to a discharge side is formed on both sides of a discharge port provided on a tip of the staple feeding passage.

DETAILED DESCRIPTION OF THE PREFERRED EMBODIMENTS

Figure 1:
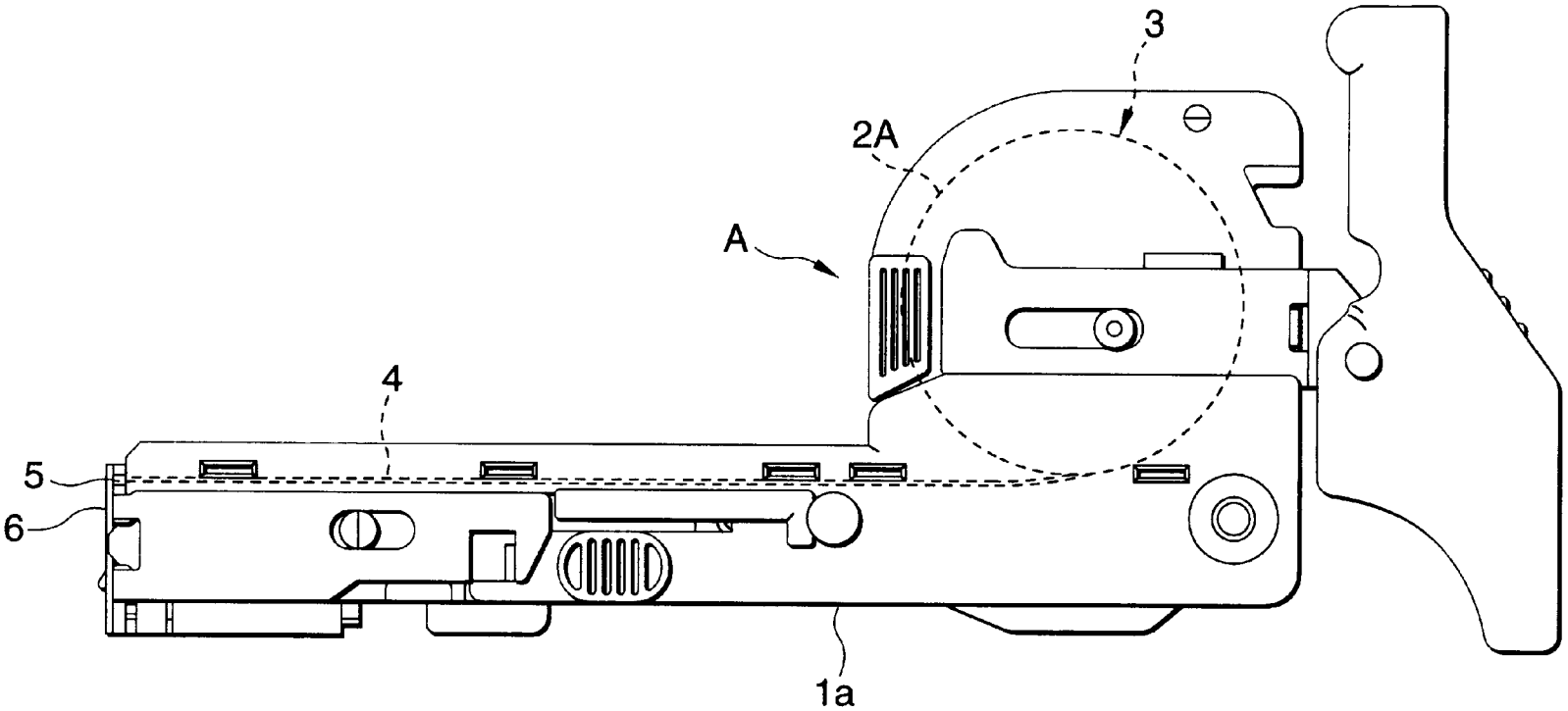
FIG. 1 is a side view showing a roll staple cartridge.
Figure 2:
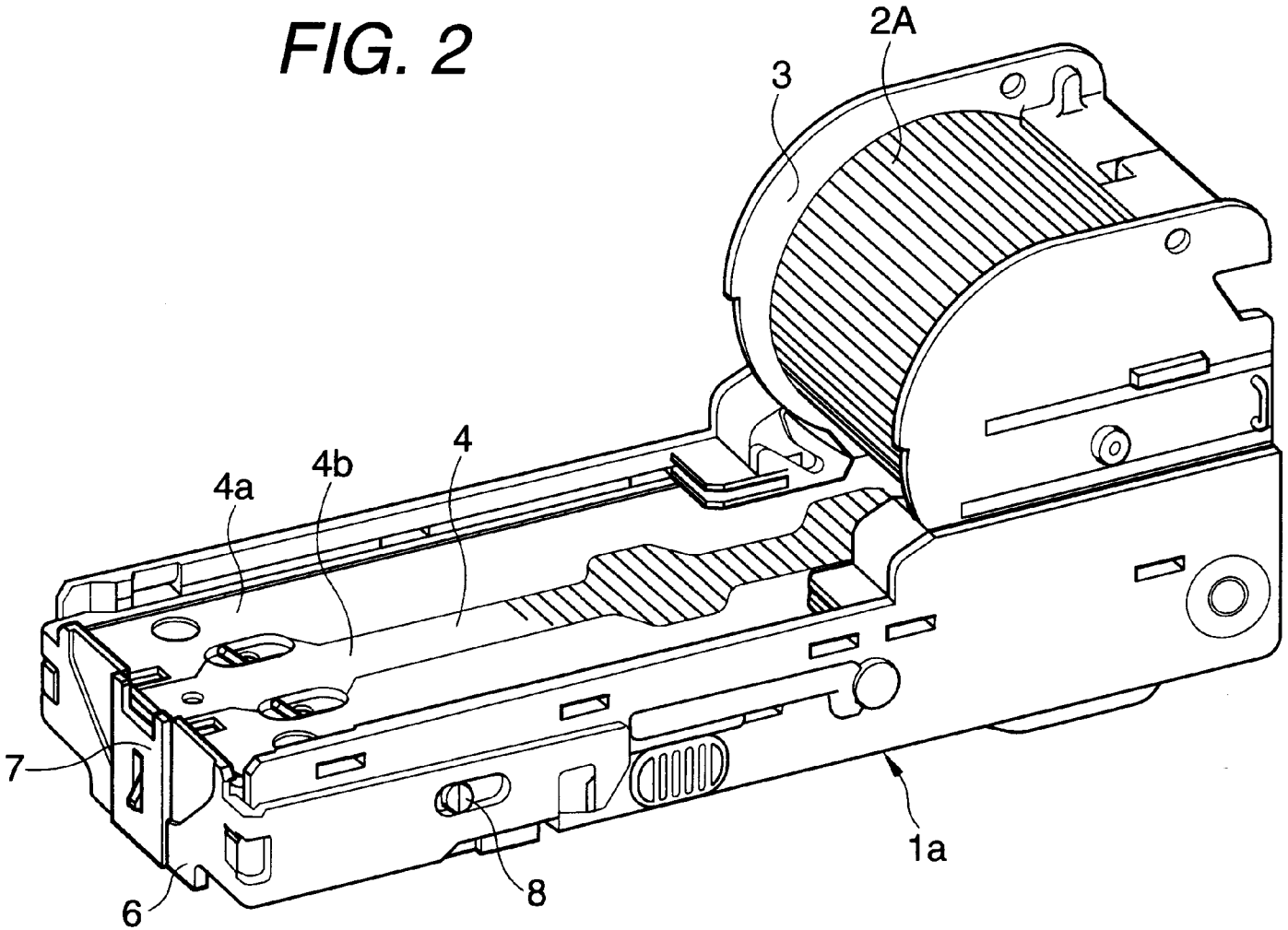
FIG. 2 is a perspective view showing the cartridge.

In FIGS. 1 and 2, A denotes a roll staple cartridge. The roll staple cartridge A comprises a cartridge body 1*a* which is provided with a storage portion 3 for a connected staple 2A and a staple feeding passage 4 for feeding, like a sheet, the connected staple 2A stored in the storage portion 3. The roll staple storage portion 3 is formed to stored the roll-shaped connected staple 2A as shown in FIG. 2. The connected staple 2A connects straight staples like an elongated band and winds them like a roll. A tip of the connected staple 2A is discharged from a discharge port 5 provided on a front end of the feeding passage 4 and is formed like a gate as will be described below, and gets into a central driving groove 7 of a face plate 6 and is driven. The face plate 6 is attached to be rotatable around a shaft 8.

A lower portion of the storage portion 3 is opened to communicate with the staple feeding passage 4 and an outermost end of the connected staple 2A is led out to pass through the staple feeding passage 4. Moreover, a cap (not shown) is attached to an upper portion of the storage portion 3 and the connected staple 2A can be stored in the storage portion 3 with the cap opened.

Figure 3:
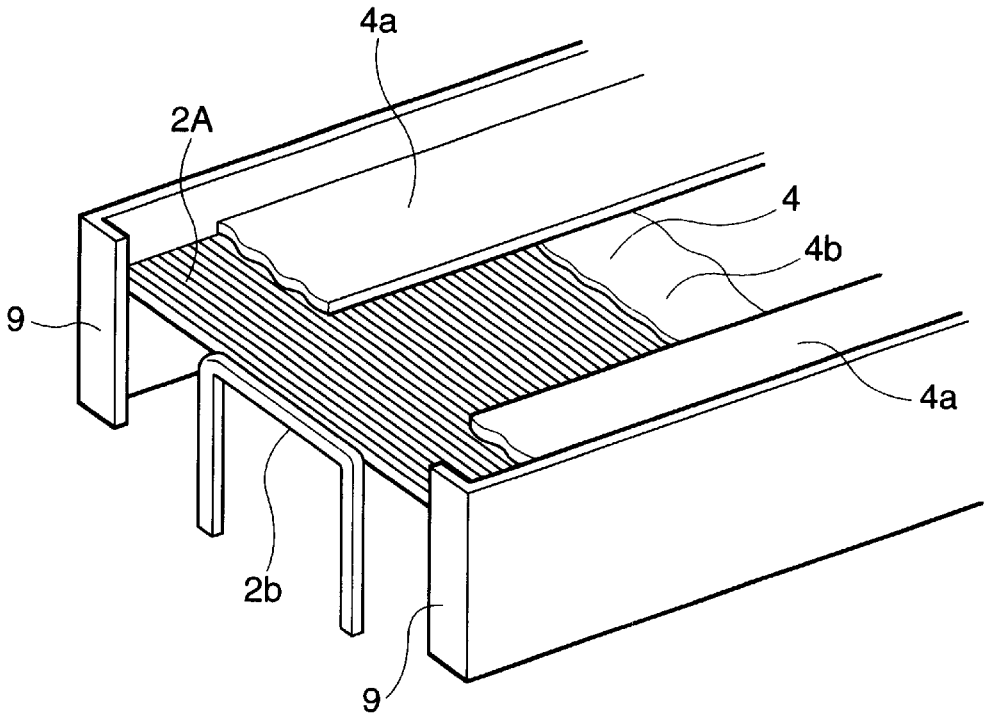
FIG. 3 is an enlarged perspective view showing an end on the discharge side of a staple feeding passage.

The staple feeding passage 4 is continuous from an open end of the lower portion of the storage portion 3, and is formed between an upper guide plate 4*a* and a lower guide plate 4*b* as shown in FIG. 3, and a reversal check pawl for preventing the connected staple 2A from flowing reversely is provided in the staple feeding passage 4, which is not shown.

A stopper 9 protruded into the inside of the staple feeding passage 4 is formed on both sides (both ends in a transverse direction) of the discharge port 5 provided on the tip of the staple feeding passage 4. (See FIG. 5) The stopper 9 is set in positions corresponding to both sides of a forming plate when a roll staple cartridge A is attached to a stapler body.

The stopper 9 is not restricted to a bent side wall of the staple feeding passage 4. Other members may be constituted.

With such a structure, when the roll staple cartridge A is attached to the stapler body, the connected staple 2A is fed to the discharge port 5 side through a feeding mechanism (not shown) provided in the stapler body. Then, both ends of the tip portion of the connected staple thus fed is engaged with the stopper 9 and cannot be moved toward the discharge side any longer, and therefore, is stopped in that position.

Figure 4:
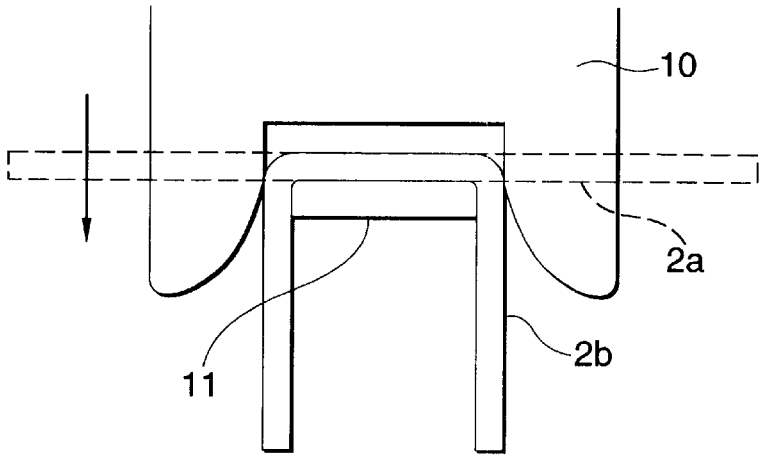
FIG. 4 is a view illustrating a manner for forming a staple.
Figure 5:
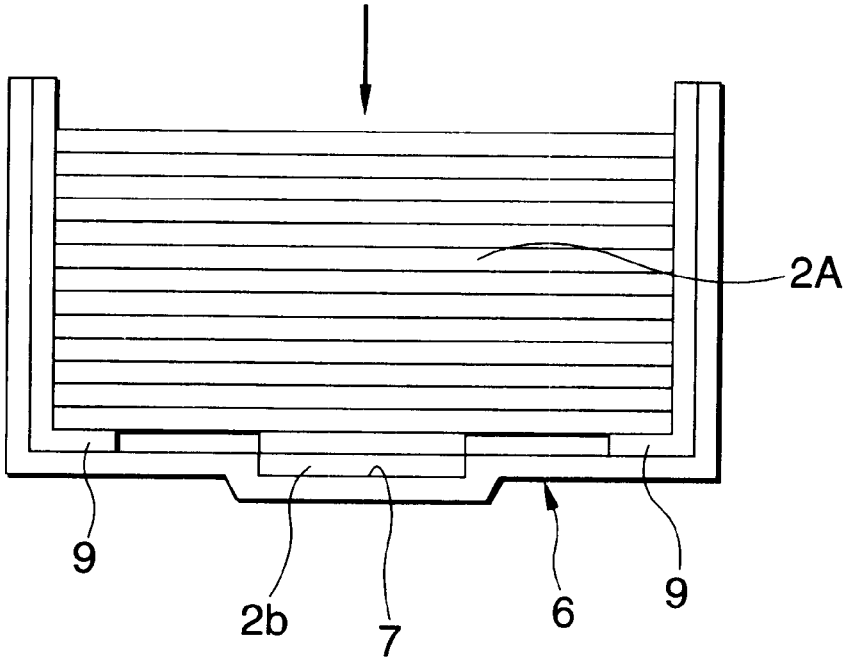
FIG. 5 is a plan view showing the end on the discharge side of the staple feeding passage.

When the forming plate 10 is operated in this state as shown in FIG. 4, a straight staple 2*a* on a head is bent and formed like a gate between an anvil 11 and the forming plate 10. Since both sides of the straight portion are bent downward during the forming operation, an engagement state with the stopper 9 is released. At the same time, a leg portion of a staple 2*b* thus formed is then pushed out toward the discharge side through a pusher (not shown). The sheet staple is also moved correspondingly toward the discharge side and the unformed straight staple 2*a* on the head is engaged with the stopper 9 and is stopped (see FIG. 3). In a normal case, the formed staple is positioned on this side of the driving groove 7 in this stage. Furthermore, when the forming plate 10 forms a next straight staple, the formed staple 2*b* on the head is fed to the driving groove 7 provided on the inside of the face plate 6 as shown in FIG. 5. Similarly, one connected staple 2A is also moved and the unformed straight staple on the head is engaged with the stopper 9 and is stopped. Next, when a driver plate is operated, the formed staple 2*b* in the driving groove 7 is driven through the driver plate and a binding operation is thus carried out. At the same time, the forming plate 10 is also operated. Therefore, the forming operation is also carried out in the next stage. By such repetition, the forming and driving operations are continuously performed.

When the formed staple is buckled and is jammed in the driving groove 7 during driving through the driver plate, it is preferable that the roll staple cartridge A should be removed from the stapler body and the face plate 6 should be rotated and opened to remove a jammed staple. Even if the face plate 6 is thus opened, the unformed staple is engaged with the stopper 9 and cannot be moved toward the discharge side. Accordingly, even if the jammed staple is pulled toward the discharge side when it is to be removed, the connected staple does not jump out of the staple passage. Therefore, only the jammed staple can be cut, separated and removed. When the jam processing is completed, it is preferable that the face plate 6 should be closed again and the cartridge should be set to the stapler body.

Figure 6:
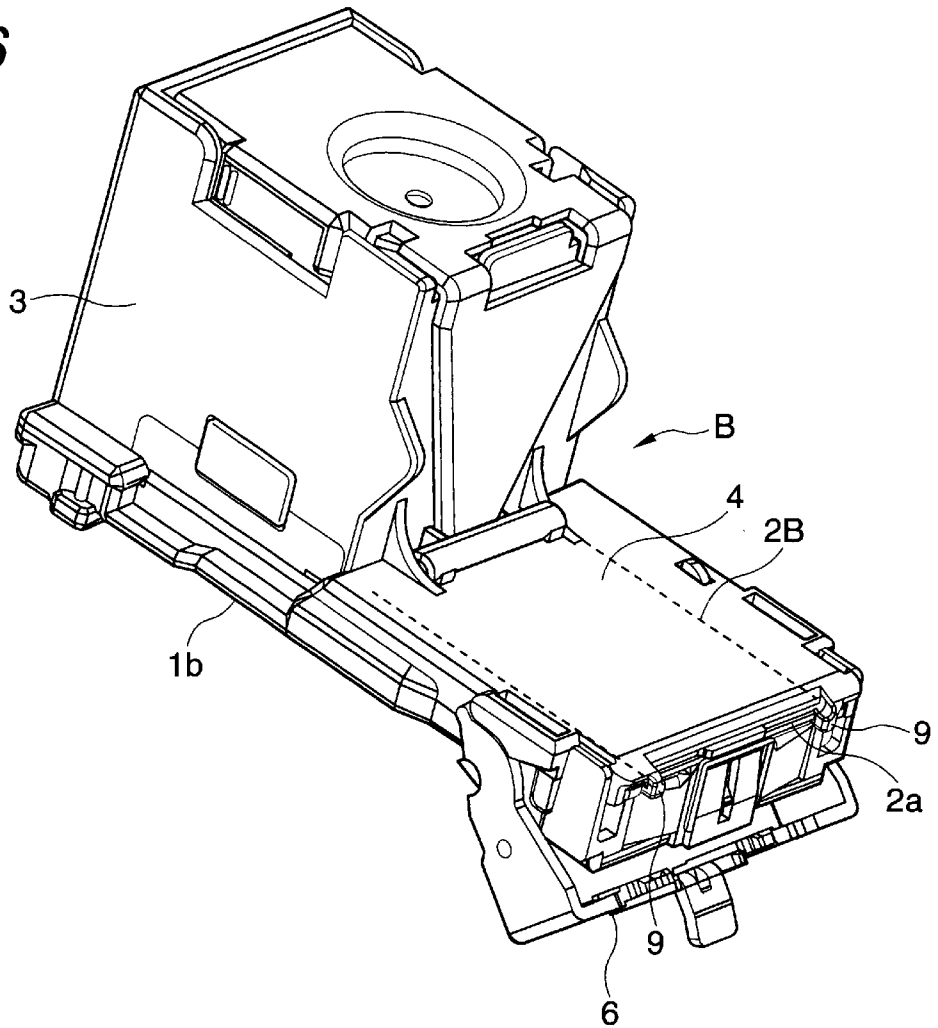
FIG. 6 is a perspective view showing a sheet staple cartridge.

Next, FIG. 6 shows an example of a sheet staple cartridge storing a sheet-type connected staple obtained by connecting a large number of straight staples like a sheet. A staple cartridge B also comprises a cartridge body 1*b* provided with a storage portion 3 for a connected staple 2B and a staple feeding passage 4 for feeding the connected staple 2B stored in the storage portion 3. The sheet-shaped connected staple 2B is stacked and stored in the storage portion 3.

A lower end of a front wall of the storage portion 3 is opened to communicate with the staple feeding passage 4 so that the sheet-shaped connected staple 2B is discharged into the staple feeding passage 4 one by one and is then fed toward the downstream side.

A stopper 9 protruded to the inside of the staple feeding passage 4 to prevent the connected staple 2B from being moved toward the discharge side is formed on both sides of a discharge port 5 on a tip of the staple feeding passage 4. A face plate 6 is attached rotatably.

Figure 7:
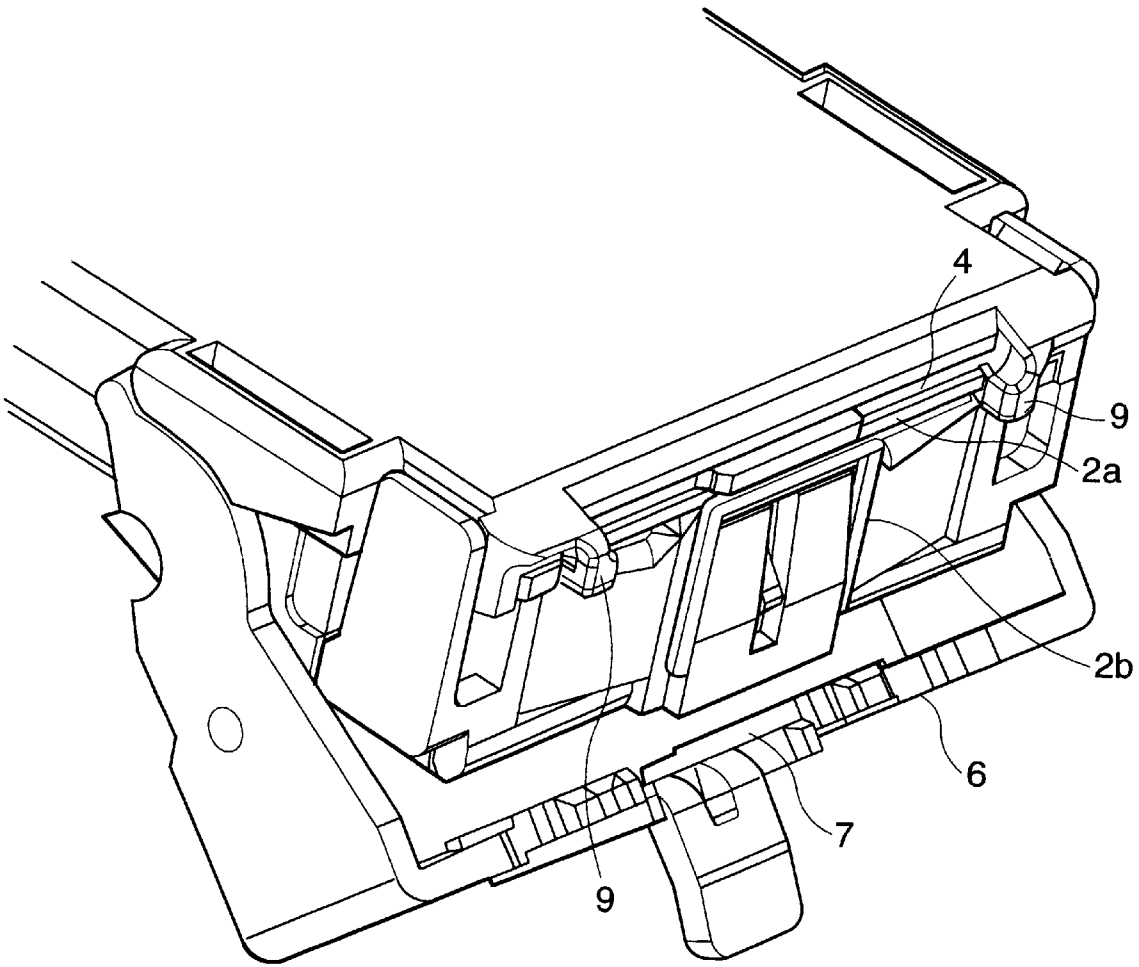
FIG. 7 is an enlarged perspective view showing an end on the discharge side of the cartridge.
Figure 8:
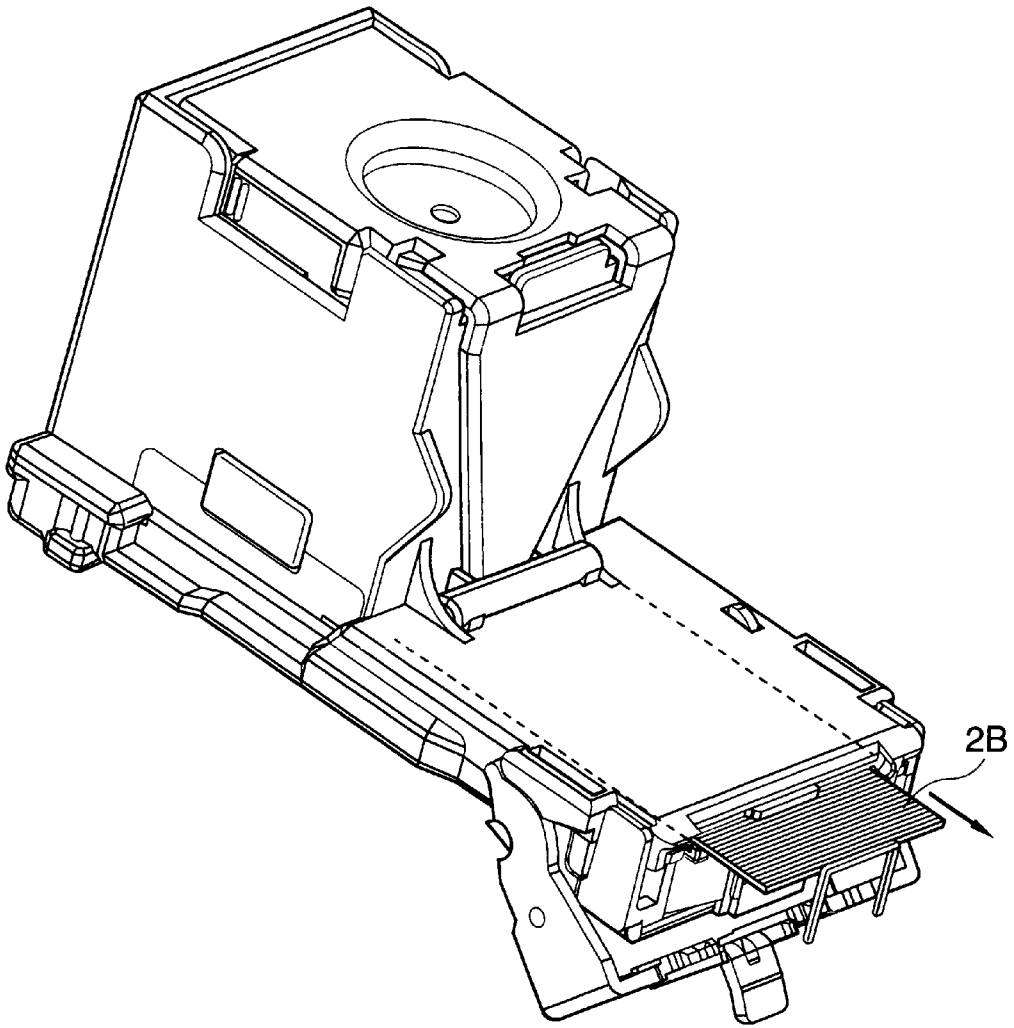
FIG. 8 PRIOR ART
FIG. 8 is a perspective view showing a conventional staple cartridge.

The staple cartridge B is also attached to a stapler body for use. In the same manner as in the above example, the connected staple 2B in the staple feeding passage 4 is fed toward the discharge side through a feeding mechanism (not shown) on the stapler body side, and is engaged with the stopper 9 and is thus stopped. Accordingly, when a staple 2*b* is formed like a gate as shown in FIG. 7, the staple 2*b* thus formed is disengaged from the stopper 9. Therefore, although the staple 2*b* is further moved toward the discharge side, the movement of an unformed staple 2*a* is stopped by the stopper 9. Then, the formed staple 2*b* on the tip is fed into a driving passage 7 of the face plate 6 and a driver plate is thereafter operated to drive the staple 2*b* and to sequentially form the succeeding unformed staples.

When the formed staple is buckled and jammed in the driving groove 7 during the projection through the driver plate, it is preferable that the staple cartridge B should be removed from the stapler body and the face plate 6 should be rotated and opened to remove the jammed staple in the same manner as in the above example. In that case, even if the jammed staple is pulled toward the discharge side, the sheet staple does not jump out of the staple passage. Therefore, only the jammed staple can be removed. When the jam processing is completed, it is preferable that the face plate 6 should be closed again and the cartridge should be set to the stapler body.

While only certain embodiments of the invention have been specifically described herein, it will be apparent that numerous modifications may be made thereto without departing from the spirit and scope of the invention.

What is claimed is:

1. A staple jump preventing mechanism for a staple cartridge including a storage portion storing a connected staple connecting a large number of straight staples and a staple feeding passage for feeding the connected staple stored in the storage portion, said staple jump preventing mechanism comprising:

a stopper, being formed on a discharge port provided on a tip of the staple feeding passage and protruded toward the staple feeding passage; the stopper engages the connected staple and prevents the connected staple from exiting the staple feeding passage when a staple cartridge face plate is absent.

2. The staple jump preventing mechanism according to claim 1, wherein said stopper is formed on both ends of the discharge port.

3. The staple jump preventing mechanism according to claim 2, wherein both ends of a tip portion of the connected staple is engaged with said stopper so that the connected staple is stopped by said stopper.

4. The staple jump preventing mechanism according to claim 1, wherein said stopper is a bent side wall of the staple feeding passage.

5. The staple jump preventing mechanism according to claim 1, wherein the connected staple is a roll staple wound like a roll.

6. The staple jump preventing mechanism according to claim 1, wherein the connected staple is obtained by connecting the straight staples like a sheet.

7. A staple jump preventing mechanism for a staple cartridge including a cartridge body, a storage portion storing a connected staple connecting a large number of straight staples and a staple feeding passage for feeding the connected staple stored in the storage portion, said staple jump preventing mechanism comprising:

a stopper provided to the cartridge body and protruded toward the staple feeding passage, said stopper engaging the straight staple in order to prevent the straight staple from being moved in a direction to which the connected staple is fed.

8. The staple jump preventing mechanism according to claim 7, wherein said stopper is formed on a discharge port provided on a tip of the staple feeding passage.

9. The staple jump preventing mechanism according to claim 7, wherein said stopper is formed on both ends of a discharge port.

10. The staple jump preventing mechanism according to claim 7, wherein both ends of a tip portion of the straight staple are engaged with said stopper so that the connected staple is stopped by said stopper.

11. The staple jump preventing mechanism according to claim 7, wherein said stopper is a bent side wall of the cartridge body.

12. The staple jump preventing mechanism according to claim 7, wherein the connected staple is a roll staple wound like a roll.

13. The staple jump preventing mechanism according to claim 7, wherein the connected staple is obtained by connecting the straight staples like a sheet.

* * * * *